US005946832A

United States Patent [19]

Koivuranta et al.

[11] Patent Number: 5,946,832

[45] Date of Patent: Sep. 7, 1999

[54] VIBRATION BUCKET ARRANGEMENT

[75] Inventors: Tapani Koivuranta, Iittala; Pekka Koivuranta, Kempele, both of Finland

[73] Assignee: Takope Oy, Oulu, Finland

[21] Appl. No.: 08/930,818

[22] PCT Filed: Apr. 11, 1996

[86] PCT No.: PCT/FI96/00193

§ 371 Date: Oct. 9, 1997

§ 102(e) Date: Oct. 9, 1997

[87] PCT Pub. No.: WO96/32545

PCT Pub. Date: Oct. 17, 1996

[30] Foreign Application Priority Data

Apr. 13, 1995 [FI] Finland ..... 951808

[51] Int. Cl.[6] ..... E02F 3/36; E02F 3/40

[52] U.S. Cl. ..... 37/444; 37/447; 37/904

[58] Field of Search ..... 37/444, 447, 904

[56] References Cited

U.S. PATENT DOCUMENTS

| | | | |
|---|---|---|---|
| 2,986,294 | 5/1961 | Granryd | 37/904 |
| 3,645,021 | 2/1972 | Sonerud . | |
| 3,732,022 | 5/1973 | Danuser | 404/133 |
| 4,250,760 | 2/1981 | Gurries | 37/904 |
| 4,359,296 | 11/1982 | Cronkhite | 404/114 |
| 4,411,081 | 10/1983 | King | 37/117.5 |
| 4,592,696 | 6/1986 | Carternock | 414/685 |
| 5,160,034 | 11/1992 | Potter . | |
| 5,195,865 | 3/1993 | Koehl . | |

*Primary Examiner*—Thomas B. Will
*Assistant Examiner*—Gary S. Hartmann
*Attorney, Agent, or Firm*—Burns, Doane, Swecker & Mathis, L.L.P.

[57] ABSTRACT

The invention relates to a vibration bucket arrangement comprising a bucket part (1) that comprises a bottom (2), a rear part (3) and lateral end parts (4 to 5). The arrangement further comprises an attachment part (6, 8, 9, 9*a* to 9*d*, 99) with which the bucket part (1) can be attached to a construction machine, and a vibration unit (10) attached to the bucket part (1), which unit comprises a vibrating assembly, such as a wabbler (10*a*, 10*b*) to be used by a regulating element. The arrangement further comprises a flexible attachment (30) on which the bucket part is arranged. In accordance with the invention, the vibration bucket arrangement comprises a locking and releasing assembly (16, 17 to 22) for locking the flexible attachment (30) of the bucket part essentially rigid when moving from vibration use to bucket use and for releasing the locking when moving from bucket use to vibration use. The flexible attachment (30) of the bucket part (1) that can be locked rigid and released from locking by the locking and releasing assembly (16, 17 to 22) is between the buckeat part (1) and the attachment part (6, 8, 9, 9*a* to 9*d*, 99).

13 Claims, 5 Drawing Sheets

VIBRATION BUCKET ARRANGEMENT

Figure 2:
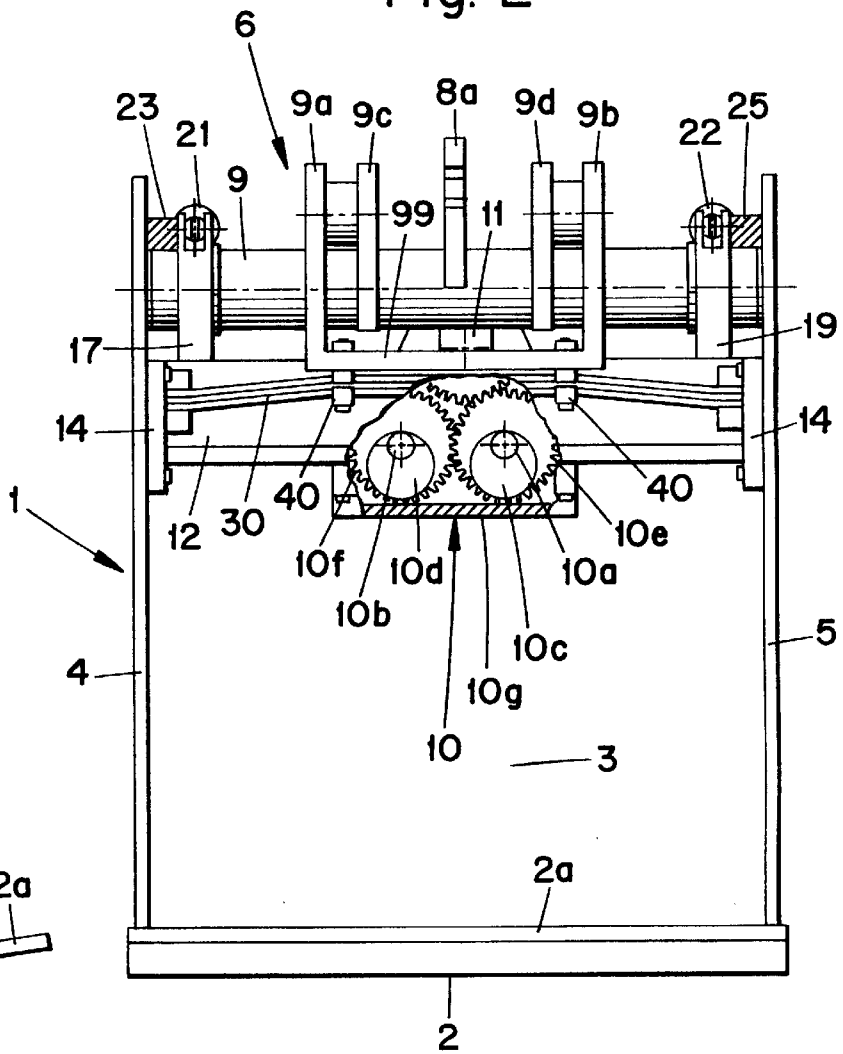

The invention relates to a vibration bucket arrangement comprising a bucket part that comprises a bottom, a rear part and lateral end parts, the arrangement further comprising an attachment part with which the bucket part can be attached to a construction machine, a vibration unit attached to the bucket part, which unit comprises a vibrating device to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use.

A vibration bucket can usually be used as an ordinary bucket for example for earth-moving, but also for vibrating earth. The vibration movement is effected by a vibration unit connected to the bucket, which unit comprises a wabbler shaft that is rotated.

One area of use for vibration buckets is the construction of foundation pits, yard areas and passages. A vibration bucket is also needed for building bridges and culverts and for paving a street, for constructing traffic islands and for building water and heating networks.

More generally, a vibration bucket can be used for projects which first require digging and moving the earth to be moved elsewhere or loading onto a truck, and which projects secondly require spreading, levelling and compacting the earth transported in its place.

Vibration buckets are already previously known. Prior art vibration buckets are used in earth-moving work and they comprise a vibrator whose task it is to improve the penetration of the bucket into the earth and help clear the earth off the bucket. FI-1153/68 discloses a simple vibration bucket in which a vibration unit outside the bucket comprises one wabbler shaft that produces an equal centrifugal power in all directions, whereby vibration will not be effective enough.

Prior art also teaches a solution in which there is a flexible attachment, that is, a damping element with flexible material around a rigid carrier pin. The object of this is to prevent vibration from moving into the boom system of the construction machine and enable vibration use. The bucket can be used both in bucket use and in vibration use, but regardless of this, it does not clearly have two positions as the action is controlled only by starting and stopping the vibrating unit. The structure of these buckets does not enable distinctive double action, that is, suitable operation solely in bucket use on the one hand and solely in vibration use on the other hand. This kind of vibration bucket is too inaccurate in bucket use as the damping element for the bucket use is flexible when loading is directed to the bucket. Prior art vibration buckets are not efficient enough for compacting earth and not suitable for both bucket use and compacting.

U.S. Pat. No. 5,195,865 discloses a solution in which there is a separate vibrating unit between the bucket and the boom system, which unit comprises a vibrating means, an upper attachment plate, damping rubbers, cylinders and locking pins by means of which the vibrating unit can be connected flexibly to the boom system and locked rigidly. The solution also comprises a lower attachment plate and second attachment cylinders and pins for attaching the vibrating unit to the bucket. In the solution according to U.S. Pat. No. 5,195,865, the vibrating unit is connected on top of the bucket of a digger as a clearly separated additional element between the boom system and the bucket. Said solution enables a flexible operation and an operation that can be locked to be rigid, but the structure is in principle and in implementation difficult because in reference cited the vibrating element is an element like a clearly separate additional element that is between the boom and the bucket on top of the bucket and not integrated into the bucket. The separate vibrating unit between the boom and the bucket causes a serious disadvantage in that the vibration power will move to the bucket via mobile connection pins, whereby the connection pins will thus be subject to wearing. The solution according to the reference cited requires a double openable attachment system, that is, the attachment of the vibrating unit both to the boom system and to the bucket. This makes the structure more difficult and complicated and raises costs.

The object of the invention is to provide a new type of vibration bucket that obviates the problems connected with prior art solutions.

This object is attained with a vibration bucket arrangement according to the invention that is characterized in that the flexible attachment of the bucket part that can be locked rigid and released from locking by the locking and releasing means is between the bucket part and the attachment part.

Several advantages are gained by the solution according to the invention. In the solution according to the invention the vibrating unit is in the bucket part and the bucket part is flexibly fixed onto the attachment part to which the boom of the construction machine has been attached, whereby in accordance with the invention the flexible attachment of the bucket part and the locking and releasing of the flexible attachment is carried out between the bucket part and the attachment part and not between the boom and the vibrating unit as in the reference cited above. The solution according to the invention does not use a separate vibrating unit between the bucket and the boom system, nor a double openable attachment system. The solution according to the invention is less complicated in structure and therefore its operation is more reliable and the costs lower. The invention renders the vibration bucket into a suitable earth-moving and compacting vibration bucket. The new vibration bucket has clearly two actions, that is, in its structure the bucket part is in bucket use essentially rigidly and without clearance attached to the attachment part, and in vibration use the bucket part rests flexibly on flexible attachment, that is, a vibration element attached most preferably onto an attachment element. The operation is controlled by locking and releasing means. The solution according to the invention enables the forming of directed vibration movement better than before. The positioning and attachment for the vibrating unit disclosed in the solution according to the invention is novel, better than before, and the invention also enables the damping element to be controlled. The solution according to the invention is compact, uncomplicated and reliable in structure. The preferred embodiments of the invention emphasize the advantages of the invention.

Figure 1:
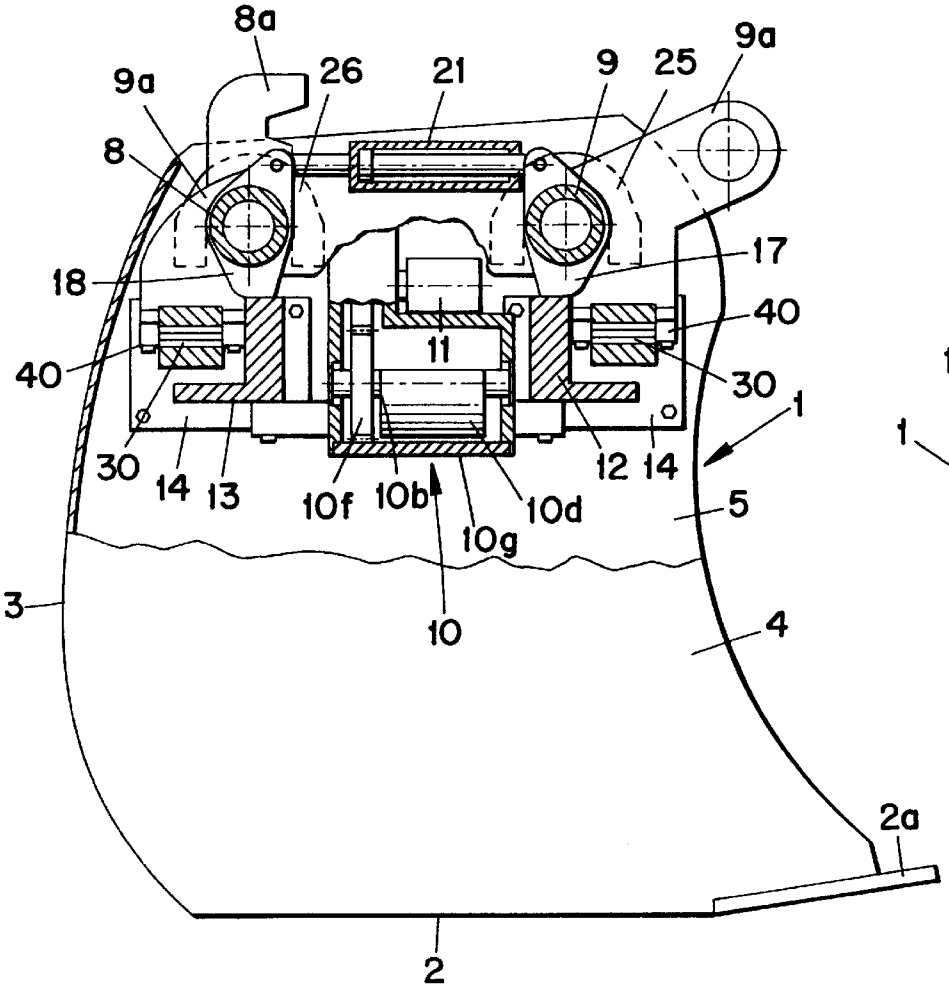
Figure 4:
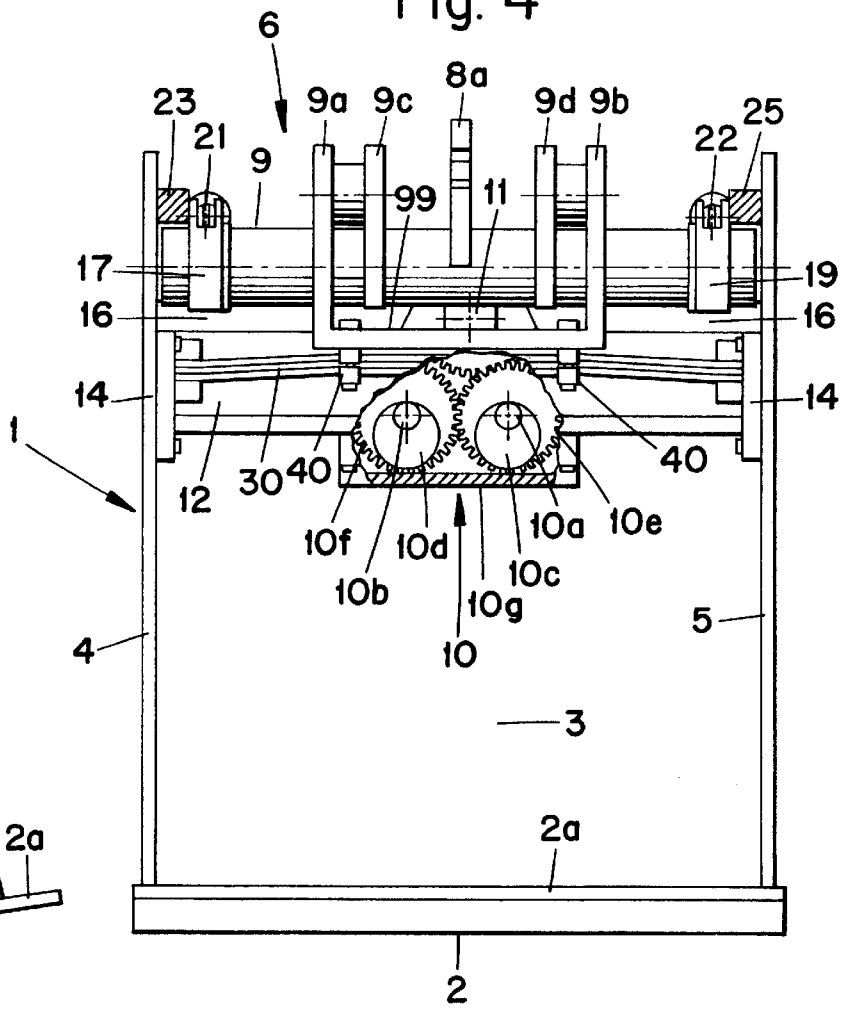
Figure 3:
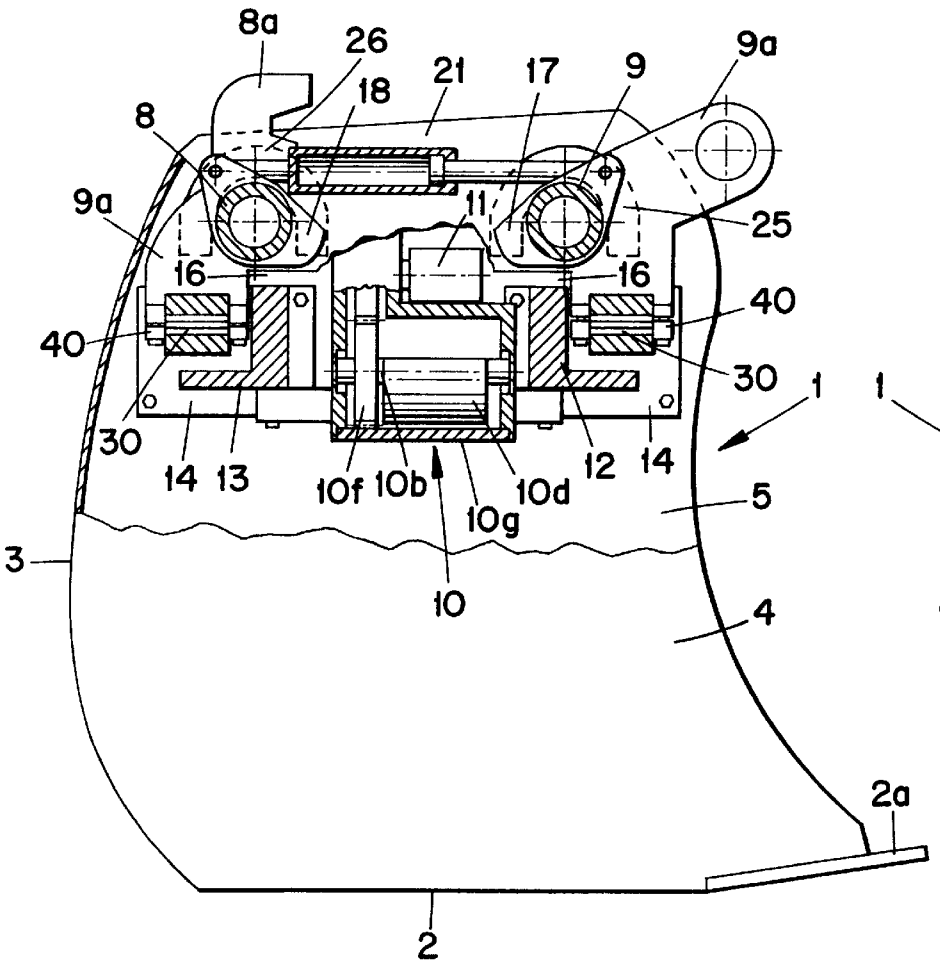
Figure 6:
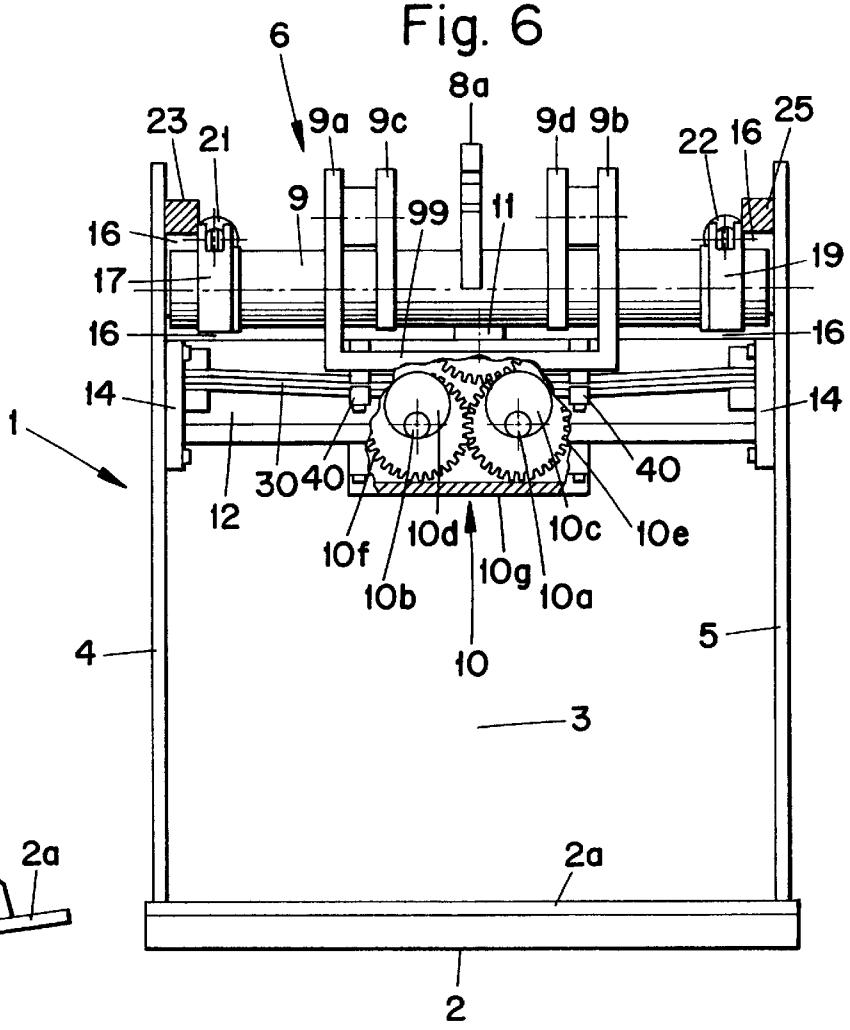
Figure 5:
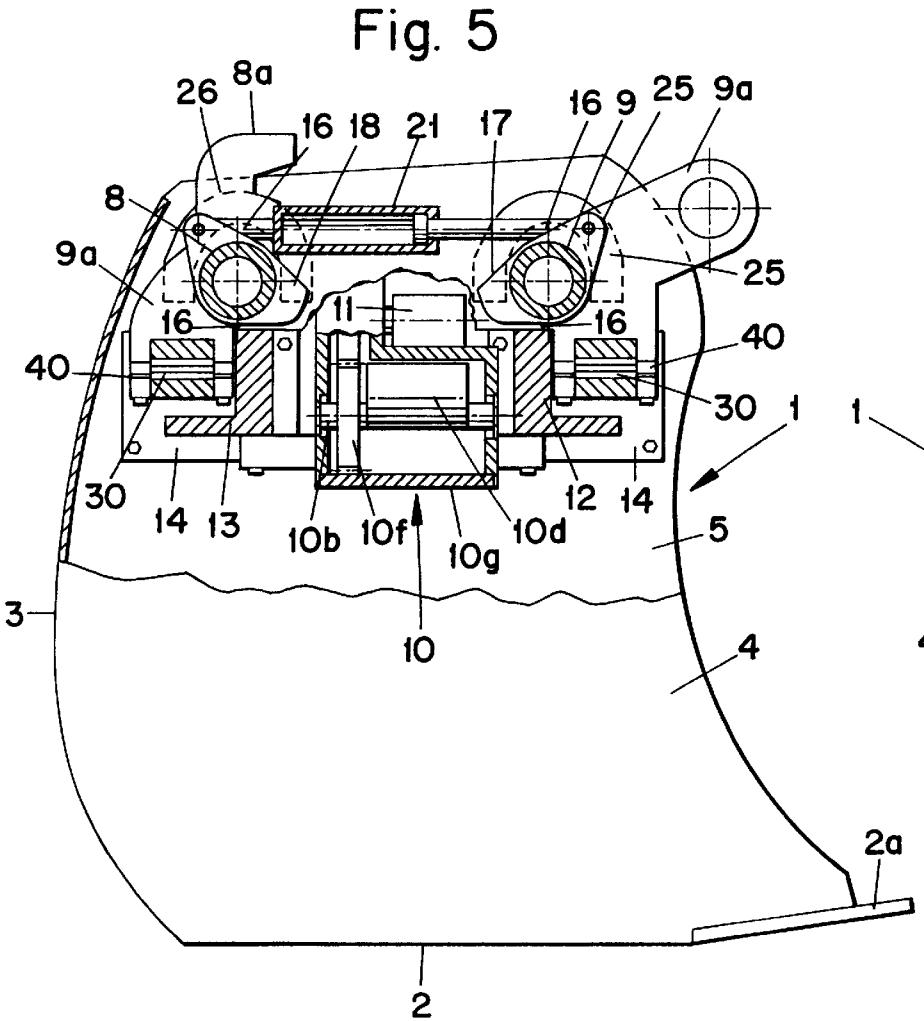
Figure 7:
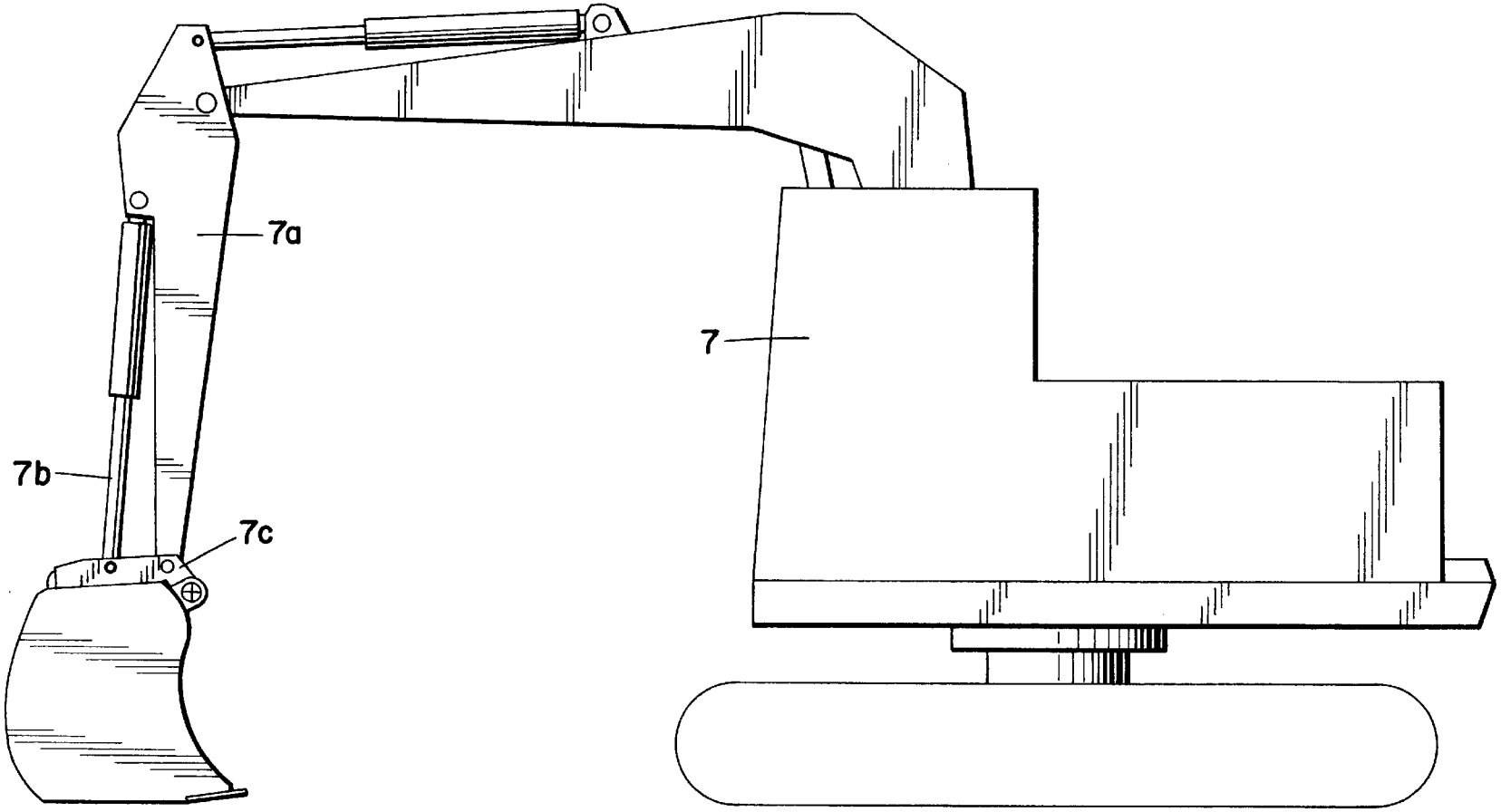
Figure 8:
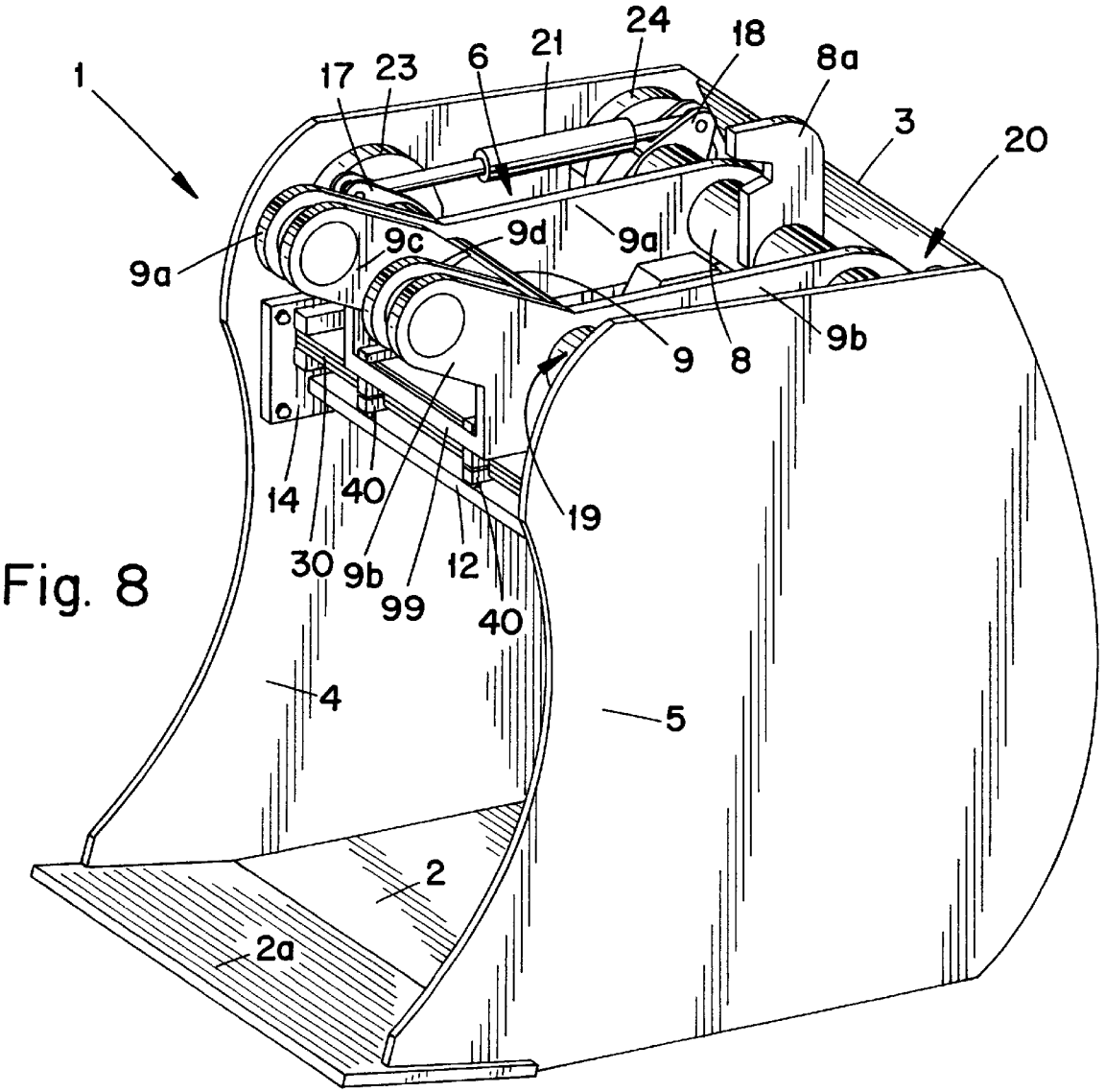

In the following, the invention will be explained in more detail with reference to the attached drawings in which FIG. 1 shows a partly sectional side view of a vibration bucket when the vibration bucket is rigid in digging position, FIG. 2 shows a front view of the vibration bucket of FIG. 1, FIG. 3 shows a partly sectional side view of the vibration bucket when vibration movement is directed downwards, FIG. 4 shows a front view of the vibration bucket of FIG. 3, FIG. 5 shows a partly sectional side view of the vibration bucket when vibration movement is directed upwards, FIG. 6 shows a front view of the vibration bucket of FIG. 5, FIG. 7 shows the vibration bucket connected to the boom system of a digger, FIG. 8 shows an obliquely upward view of the vibration bucket.

The figures relate to a vibration bucket arrangement comprising a bucket part 1, a bottom 2, a jaw plate 2*a*, a rear part 3 and lateral end parts 4 to 5. The structures 2 to 5 form the frame of the bucket part. The vibration bucket arrangement further comprises an attachment part 6 with which the bucket part 1 can be attached to a rapid attachment means 7*c* of a boom system 7*a* of a construction machine 7 or directly to lugs and a cylinder 7*b* of the boom system 7*a*. The attachment part 6 comprises lateral rods 8 to 9, such as transverse girders 8 to 9, that is, most preferably tubular girders 8 to 9, attachment means 8*a* and 9*a* to 9*d*, that is, attachment lugs 8*a* and 9*a* to 9*d*. Elongated outer lugs 9*a* and 9*d* are fixed onto tubular girders 8 and 9. Inner lugs 9*c* and 9*d* are also fixed onto the tubular girder 9. A rear lug 8*a* is also fixed onto the tubular girder 8. In FIG. 7 the boom system 7*a* of the construction machine 7 and its roll cylinder 7*b* is connected by means of the rapid attachment means 7*c* to lugs 9*a* to 9*d* and 8*a* of the attachment part 6. The arrangement also comprises a flexible attachment 30 for the bucket part 1. The flexible attachment 30 acts as a damping element preventing vibration from moving towards the boom system of the construction machine 7.

The vibration bucket arrangement also comprises a vibrating unit 10 attached to the bucket part 1, which unit comprises wabbler shafts 10*a*, 10*b* rotatable by a regulating element 11. The vibrating unit 10 transmits the vibration it produces to the bucket part 1, whereby the desired result is attained, that is, the vibration of the bucket which is utilized in compacting earth, for instance. The vibration unit 10 is most preferably fixed onto lateral rods 12 and 13 between the lateral ends 4 and 5. The lateral rods 12 and 13 are in the figures L-shaped transverse girders 12 and 13 which are fixed by means of attachment plates 14 to the frame part of the bucket in the upper section of the lateral ends 4 to 5 of the bucket part. The vibrating unit 10 comprises wabbler shafts 10*a* and 10*b* provided with wabblers 10*c* and 10*d*, which shafts are connected to one another by means of gears 10*e* and 10*f*. The wabbler shafts 10*a* and 10*b* are mounted in bearings into a chamber part 10*g* of the vibrating unit 10. Because of the gears 10*e*, 10*f* between the wabbler shafts 10*a*, 10*b*, the wabbler shafts 10*a*, 10*b* are arranged to rotate in opposite directions. The wabbler weights 10*c*, 10*d* are positioned so that they are simultaneously up (FIGS. 5 and 6) and half a revolution later simultaneously down (FIGS. 3 and 4), whereby they produce a vertically progressing directed vibration movement, which is very advantageous in use. The wabbler shafts 10*a*, 10*b* cancel out each other's effect in other directions than the vertical direction. Other vibrating elements can be used in the place of the rotatable wabblers. The vibrating unit 10 is connected rigidly, i.e. fixedly onto the bucket 1.

In order to attain suitable double action, locking and releasing means 16, 17 to 22 comprise a locking space 16 between the bucket part 1 and the attachment part 6 and closing and opening means 17 to 22 in cooperation with the locking space.

In order to attain suitable double action, the vibration bucket arrangement according to the invention comprises locking and releasing means 16 and 17 to 22 for locking the flexible attachment 30 of the bucket part 1 essentially rigid when moving from vibration use to bucket use and for releasing the locking when moving from bucket use to vibration use. FIGS. 1 and 2 show a rigid position (locking on). FIGS. 3 to 4 and 5 to 6 show a flexible position (locking off) in the opposite extreme points of the vibration movement. In order to attain suitable double action, the locking and releasing means 16, 17 to 22 comprise a locking space 16 between the bucket part 1 and the attachment part 6 and closing and opening means 17 to 22 in cooperation with the locking space.

The flexible attachment 30 of the bucket part 1 that can be locked rigid and released from locking with locking and releasing means 16, 17 to 22 is between the bucket part 1 and the attachment part 6, 8, 9, 9*a* to 9*d*, 99.

In a preferred embodiment shown in the figures, the vibration bucket arrangement in accordance with the invention comprises in vibration use an open or at least an openable motion space 16, and closing and opening means 17 to 22 for closing said motion space 16 when moving from vibration use to bucket use and for opening the motion space 16 when moving from bucket use to vibration use. The motion space 16 can be filled with some yielding substance, whereby the motion space is not open but as a result of straining will open as the soft substance is compressed. The motion space 16 can be seen for example in FIGS. 3 and 4 in which vibration movement is directed downwards. The motion space 16 can also be seen in FIGS. 5 and 6 in which vibration movement is directed upwards. In FIGS. 1 and 2, however, the motion space is closed, that is, the closing means 17 to 20 have closed the motion space 16 by means of the means 21 to 22, i.e. by means of cylinders, whereby the structure is rigid.

In a preferred embodiment of the invention, the closing and opening means 17 to 22 of the motion space comprise at least one closing and opening element 17 to 20 for closing and opening the motion space 16 and at least one regulating element 21 to 22 for changing the position of the closing and opening element. There are four closing and opening elements 17 to 20 and two regulating elements 21 to 22 in the preferred embodiment shown in the figures.

In one preferred embodiment of the invention, the closing and opening means in the vibration bucket arrangement comprise at least two closing and opening elements on both sides of the bucket, that is, elements 17 to 18 and 19 to 20, whereby there are two successive and two parallel supporting points between the bucket part 1 and the attachment part 6, 8, 9, whereby supporting will be reliable and balanced. In the arrangement of the preferred embodiment of the invention, at least two of the closing and opening elements 17 to 20 have a common regulating element. It can be seen in the figures that the closing and opening elements 17 and 18 have a common regulating element 21 and the remaining two closing and opening elements 19 and 20 have a common regulating element 22.

In a preferred embodiment, the closing and opening elements 17 to 20 and most preferably even their regulating elements 21 to 22 are arranged in connection with the attachment part 6, 8, 9, especially in connection with lateral rods 8, 9, that is, tubular girders 8, 9. Means 17 to 22 form turnable cam levers with which double action is controlled. Said preferred embodiments simplify the structure. In a preferred embodiment of the invention, the vibration bucket arrangement comprises adjusting means 17 to 22 for adjusting the size of the motion space 16, and these means are most preferably the closing and opening means 17 to 20 and 21 to 22 used for opening and closing the motion space 16, i.e. cam levers 17 to 20 whose position is adjusted by means of regulating elements 21 to 22, i.e. hydraulic cylinders 21 to 22. Said embodiment will diversify the operation and use of the equipment.

In a preferred embodiment of the invention, the lateral rods 8, 9, that is, tubular girders 8, 9 in the attachment part 6 are arranged to the motion space 16. The vibration unit 10 vibrates the bucket part 1, wherefore the motion space 16 moves in the vertical direction with respect to the tubular girders 8, 9 when the bucket part 1 moves its vertical vibration movement. In a preferred embodiment of the figures, both tubular girders 8, 9 are arranged into the motion space, or rather the motion space 16 is arranged around the tubular girders 8, 9, most preferably around the ends of tubular girders so that the motion space 16 is above and below the tubular girders 8, 9.

In a preferred embodiment of the invention, when the closing and opening means 17 to 22 are in a position in which the motion space 16 is closed, the bucket part 1 is supported on its counter means 23 to 26 and 12 to 13 essentially rigidly and without a dead zone to the attachment part 6, that is, to the lateral rods 8, 9 of the attachment part. This can be seen in FIGS. 1 and 2.

In one preferred embodiment of the arrangement, the counter means 23 to 26 and 12 to 13 of the bucket part 1 comprise one or more upper counter means 23 to 26 and one or more lower counter means 12 to 13, and that the motion space 16 is between the upper counter means 23 to 26 and the lower counter means 12 to 13. In the preferred embodiment shown in the figures, the arrangement comprises four upper counter means 23 to 26 and two lower counter means 12 to 13.

It can be seen in the figures that in a preferred embodiment the upper counter means 23 to 26 are curved counter means 23 to 26 and the lower counter means 12 to 13 are lateral rods 12 to 13 between the lateral ends 4 to 5 of the bucket part 1. The lateral rods 12 to 13 are in the figures L-shaped transverse girders. The curved counter means 23 to 26 restrict the movement of the frame of the bucket part 1 downwards with respect to the attachment part 6, that is, with respect to the tubular girders 8, 9.

The counter elements 23 to 25, i.e. the curved counter means are attached to the inner surface of the lateral end plates 4 and 5.

In a preferred embodiment of the vibration bucket system shown in the figures, the frame of the bucket part 1 is supported by a flexible attachment 30, that is, the damping element 30 when the closing and opening means 17 to 22 are in a position in which the motion space 16 is open. Most preferably in such a way that when the closing and opening means 17 to 22 are in a position in which the motion space 16 is open, the bucket part 1 rests on the attachment part 6, 8, 9 by means of the flexible attachment, that is, by means of the damping element 30. In that case the structure is compact and the structural parts are mostly in the upper section of the bucket, and on the one hand, they do not diminish the inner capacity of the bucket and on the other hand, they are not subject to straining even outside the bucket.

In the structure according the figures, the flexible attachment, that is, the damping element 30 is fixed onto the attachment part 6, 8, 9, the flexible attachment 30 is supported onto the lateral ends 4 to 5 of the bucket part and the flexible attachment 30 is arranged to prevent vibration from moving into the boom system of the construction machine 7. The damping power of the flexible attachment 30 is directed to the lateral direction. In that case, the flexible attachment, that is, the damping element 30 operates as is suitable for its purpose. The flexible attachment 30 most preferably comprises two spring means 30 that are most preferably at different sides of the vibrating unit 10, whereby a sufficient and even elasticity is attained.

The figures also disclose a preferred embodiment in which the arrangement comprises adjusting means 40 for adjusting the rigidity of the flexible attachment 30. The adjusting means 40 preferably form attachment means 40 with which the flexible attachment 30 is attached to the attachment part 6, 8, 9, that is, more exactly, to the part 99 between the outer lugs 9*a*, 9*b* of the attachment part 6, 8, 9.

It can be seen in the figures that in a preferred embodiment the vibrating unit 10 is positioned in the upper section of the middle line of the bucket, and most preferably so that the vibrating unit 10 is in the middle area of the bucket both when viewed in the longitudinal direction and in the cross direction of the bucket. In that case, the effect of the vibrating unit 10 will be most symmetrical and even.

The invention has been explained above by way of example with reference to the attached drawings. It does not intend to restrict the invention, but various modifications are possible within the scope of the inventive idea disclosed in the appended claims.

We claim:

1. A vibration bucket arrangement comprising a bucket part that comprises a bottom, a rear part and lateral end parts, the bucket part further comprising an attachment part with which the bucket part is attachable to a construction machine, and a vibration unit, which unit comprises a vibrating means to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use, wherein the flexible attachment of the bucket part that is rigidly lockable and releasable from locking by the locking and releasing means is between the bucket part and the attachment part, and wherein the locking and releasing means comprise a locking space between the bucket part and the attachment part and closing and opening means in cooperation with the locking space.

2. A vibration bucket arrangement comprising a bucket part that comprises a bottom, a rear part and lateral end parts, the bucket part further comprising an attachment part with which the bucket part is attachable to a construction machine, and a vibration unit, which unit comprises a vibrating means to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use, wherein the flexible attachment of the bucket part that is rigidly lockable and releasable from locking by the locking and releasing means is between the bucket part and the attachment part, and wherein the locking and releasing means in vibration use comprise at least an openable motion space and closing and opening means for closing said motion space when moving from vibration use to bucket use and for opening it when moving from bucket use to vibration use.

3. A vibration bucket arrangement according to claim 2, wherein when the closing and opening means are in a position in which the motion space is closed, the bucket part is supported by its counter means essentially rigidly and without clearance to the attachment part.

4. A vibration bucket arrangement according to claim 3, wherein the counter means in the bucket part comprise one or more upper counter means and one or more lower counter means, and that the motion space is between the upper counter means and the lower counter means.

5. A vibration bucket arrangement according to claim 4, wherein the upper counter means are curved counter means open from below, and that the lower counter means are lateral rods between the lateral ends of the bucket part.

6. A vibration bucket arrangement according to claim 2, wherein when the closing and opening means are in a position in which the motion space is open, the bucket part rests on the attachment part by means of the flexible attachment.

7. A vibration bucket arrangement according to claim 2, wherein the closing and opening means for closing and opening the motion space comprise at least one closing and opening element and at least one regulating element for changing the position of the closing and opening element, and that the opening and closing elements are arranged in connection with the attachment part.

8. A vibration bucket arrangement according to claim 7, wherein at least two closing and opening elements have a common regulating element.

9. A vibration bucket arrangement according to claim 2, wherein closing and opening means comprise at least two closing and opening elements on both sides of the bucket part.

10. A vibration bucket arrangement according to claim 2, wherein the vibration bucket arrangement comprises adjusting means for adjusting a size of the motion space, and these means are most preferably closing and opening means used for closing and opening the motion space.

11. A vibration bucket arrangement comprising a bucket part that comprises a bottom, a rear part and lateral end parts, the bucket part further comprising an attachment part with which the bucket part is attachable to a construction machine, and a vibration unit, which unit comprises a vibrating means to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use, wherein the flexible attachment of the bucket part that is rigidly lockable and releasable from locking by the locking and releasing means is between the bucket part and the attachment part, and wherein the flexible attachment is fixed onto the attachment part, that the flexible attachment is supported onto the lateral ends of the bucket part, and that the flexible attachment is arranged to prevent vibration from moving into a boom system of a construction machine.

12. A vibration bucket arrangement comprising a bucket part that comprises a bottom, a rear part and lateral end parts, the bucket part further comprising an attachment part with which the bucket part is attachable to a construction machine, and a vibration unit, which unit comprises a vibrating means to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use, wherein the flexible attachment of the bucket part that is rigidly lockable and releasable from locking by the locking and releasing means is between the bucket part and the attachment part, and wherein the vibration bucket arrangement comprises adjusting means for adjusting the rigidity of the flexible attachment.

13. A vibration bucket arrangement comprising a bucket part that comprises a bottom, a rear part and lateral end parts, the bucket part further comprising an attachment part with which the bucket part is attachable to a construction machine, and a vibration unit, which unit comprises a vibrating means to be used by a regulating element, the arrangement further comprising a flexible attachment on which the bucket part is arranged, and that the vibration bucket arrangement comprises locking and releasing means for locking the flexible attachment of the bucket part essentially rigid when moving from vibration use to bucket use and for releasing the locking when moving from bucket use to vibration use, wherein the flexible attachment of the bucket part that is rigidly lockable and releasable from locking by the locking and releasing means is between the bucket part and the attachment part, and wherein the vibrating unit is fixed onto a lateral rod between the lateral ends of the bucket part, that the vibrating unit is positioned in the upper half of a middle line of the vibration bucket, and that the vibrating unit is in a middle area of the bucket part when viewed in a longitudinal direction and in a cross direction of the bucket part.

* * * * *